US007051797B2

(12) United States Patent
de Leeuw

(10) Patent No.: US 7,051,797 B2
(45) Date of Patent: May 30, 2006

(54) HEAT EXCHANGER

(75) Inventor: Pieter Theunis de Leeuw, Apeldoom (NL)

(73) Assignee: Bronswerk Heat Transfer B.V., Nijkerk (NL)

( * ) Notice: Subject to any disclaimer, the term of this patent is extended or adjusted under 35 U.S.C. 154(b) by 0 days.

(21) Appl. No.: 09/965,767

(22) Filed: Sep. 27, 2001

(65) Prior Publication Data

US 2002/0079094 A1 Jun. 27, 2002

(30) Foreign Application Priority Data

Apr. 11, 2000 (NL) ..... 1014916

(51) Int. Cl.
*F28F 9/02* (2006.01)

(52) U.S. Cl. ..... 165/158; 165/71; 165/175; 165/178; 138/89

(58) Field of Classification Search ..... 165/158, 165/168, 178, 175, 71, 176; 138/89
See application file for complete search history.

(56) References Cited

U.S. PATENT DOCUMENTS 1,621,742 A * 3/1927 Kessler ..... 165/168
1,818,387 A * 8/1931 Dinzl ..... 165/168
2,110,024 A * 3/1938 Miller ..... 165/176
2,608,388 A * 8/1952 Miller ..... 165/175
2,920,874 A * 1/1960 Gardner ..... 165/158
3,229,762 A * 1/1966 Vollhardt ..... 165/178
3,260,307 A * 7/1966 Dawson ..... 165/158
4,117,885 A * 10/1978 Nickerson et al. ..... 165/176
4,318,441 A * 3/1982 Belleli ..... 165/81
4,452,070 A * 6/1984 Kipp ..... 138/89
4,503,934 A * 3/1985 Stephanus et al. ..... 138/89
4,600,036 A * 7/1986 Noe ..... 138/89
5,035,266 A * 7/1991 Benson et al. ..... 138/89
5,035,283 A 7/1991 Brücher et al.
5,762,130 A * 6/1998 Uibel et al. ..... 165/71
5,813,453 A 9/1998 Brucher
6,161,614 A * 12/2000 Woodhull et al. ..... 165/178

FOREIGN PATENT DOCUMENTS

DE 44 30 338 8/1994

* cited by examiner

*Primary Examiner*—Leonard R. Leo
(74) *Attorney, Agent, or Firm*—Merchant & Gould P.C.

(57) ABSTRACT

A heat exchanger, comprising a shell designed as a pressure vessel, provided with shell-sided supply and discharge means with which the shell can be flowed through with a first medium under pressure. The heat exchanger further comprises a nest of tubes extending at least partly within the shell, provided with tube-sided supply and discharge means with which the tubes from the nest can be flowed through with a second medium in heat exchanging contact with the first medium under pressure. The individual tubes of the nest are each included with a supply and a discharge side in tube bores extending substantially transversely to the plane of a tube plate included in the shell. The heat exchanger has the special feature that the tubes are connected with the tube-sided supply and discharge means via connecting channels located in the plane of the tube plate and crossing the tube holes.

13 Claims, 5 Drawing Sheets

HEAT EXCHANGER

The invention relates to a heat exchanger, comprising a shell designed as a pressure vessel, provided with shell-sided supply and discharge means with which the shell can be flowed through with a first medium under pressure, further comprising a nest of tubes extending at least partly within the shell, provided with tube-sided supply and discharge means with which the tubes from the nest can be flowed through with a second medium in heat exchanging contact with the first medium under pressure, of which nest the individual tubes are each included with a supply and discharge side in tube bores extending substantially transversely to the plane of a tube plate included in the shell.

Such a heat exchanger is known from practice as a heat exchanger of the "shell and tube type" and is used for exchanging heat between two mediums under pressure.

With the known heat exchanger, in the event of high pressures of the mediums, the tube-sided supply and discharge means are connected with the tubes via a so-called D-head, as mentioned in the TEMA $8^{th}$ edition, FIG. N1.2, or variations thereon. The D-head comprises a tube plate manufactured from wrought iron, in which tube bores are provided. The tube plate is provided with an integrated upright circumferential edge, which can be closed with the aid of a detachable cover part to form a central pressure chamber extending along the tube plate. Often, the central pressure chamber is divided into a supply and a discharge part by means of a partition. The supply and discharge means are designed as tubes which are each connected with the central pressure chamber via a tube-sided supply and discharge opening, provided in the upright circumferential edge.

During use, the nest of tubes is flowed through with the second medium via the tube-sided supply and discharge means. The second medium flows from a supply tube via the tube-sided supply opening into the supply part of the central chamber. Subsequently, the second medium flows from the supply part of the central chamber in a flow direction extending substantially transversely to the plane of the tube plate via the tube bores into the tubes. Subsequently, the second medium flows via the tube bores substantially transversely to the plane of the tube plate from the tubes into the discharge part of the central chamber. Then, the second medium flows into a discharge tube via the tube-sided discharge opening through the upright edge.

In the above-mentioned case, the nest of tubes is substantially U-shaped from the supply part of the central chamber to the discharge part of the central chamber. The supply and discharge sides of the individual tubes are included in the same tube plate.

However, the heat exchanger according to the opening paragraph can also comprise two D-heads between which the nest of tubes extends. In such a case, the supply and discharge sides of the individual tubes from the nest of tubes are included in tube bores of different tube plates; then, two tube plates are included in the shell. The central chamber of the second D-head can function as a connecting chamber, but can also function as a separate outflow chamber, the central chamber in the first D-head only functioning as inflow chamber.

A drawback of the known heat exchanger of the shell and tube type is that the D-head has to be of very robust design. In particular, this is the case when the difference between the pressure exerted by the second medium in the central chamber and the pressure exerted by the first medium in the pressure vessel is large. The pressure exerted by the second medium actually results in a large pressure load on the plane of the tube plate. Further, as a result of the high pressure of the second medium, the cover part and its connection also have to be of very robust design. The robust D-head is heavy, relatively expensive in manufacture and, further, takes up relatively much space. Additionally, to clean the nest of tubes, the cover part has to be detached and placed back, which, considering the pressure-resistant robust sealing of the cover part, is a time-consuming operation.

The invention has for its object to provide a heat exchanger of the type mentioned in the opening paragraph, in which the above-mentioned drawbacks are avoided. To that end, the heat exchanger according to the invention is characterized in that the tubes are connected with the tube-sided supply and discharge means via connecting channels situated in the plane of the tube plate and crossing the tube holes. The use of connecting channels integrated into the tube plate ensures that a central pressure chamber extending along the plane of the tube plate can be avoided. In particular, the connecting channels integrated into the tube plate can ensure that the resulting pressure load exerted on the tube plate is substantially neutral, so that the construction of the tube plate can be considerably lighter. Furthermore, as the use of the central pressure chamber extending along the plane of the tube plate is avoided, the upright edge and the cover part of the conventional D-head can be omitted. Thus, the construction can be considerably lighter and can be of simpler design, and the length of the heat exchanger can be reduced.

In an advantageous embodiment, the connecting channels are designed as straight connecting bores, each crossing at least two tube bores. One connecting bore can cross, for instance, one row of tube bores. One connecting bore can also cross, for instance, parallel rows of tube bores.

In a further advantageous embodiment, the tube bores are designed to be continuous, and the tube bores, at their free ends, are sealed with plugs. This ensures that the tubes, each individually, can be accessible for cleaning purposes. Preferably, the tube bores are provided with screw thread for detachably receiving a plug provided with corresponding screw thread. Preferably, clamping means are provided for clampingly receiving a sealing ring between a top face of the tube plate and the plug.

The supply and discharge means can be designed as tube ends provided on the peripheral edge of the tube plate or as radially outwardly extending distribution chambers. Further, the supply and discharge means can be designed as tubes connected with the connecting channels via a tee. Optionally, the connecting bores can be interconnected by means of one or more central connecting channels.

Further advantageous embodiments of the invention are represented in the subclaims.

The invention will be explained in more detail with reference to an exemplary embodiment represented in a drawing. In the drawing.

In the Figures, identical or corresponding parts are designated by the same reference numerals. The Figures are mere schematic representations in elucidation of a preferred embodiment of the invention.

Figure 1:
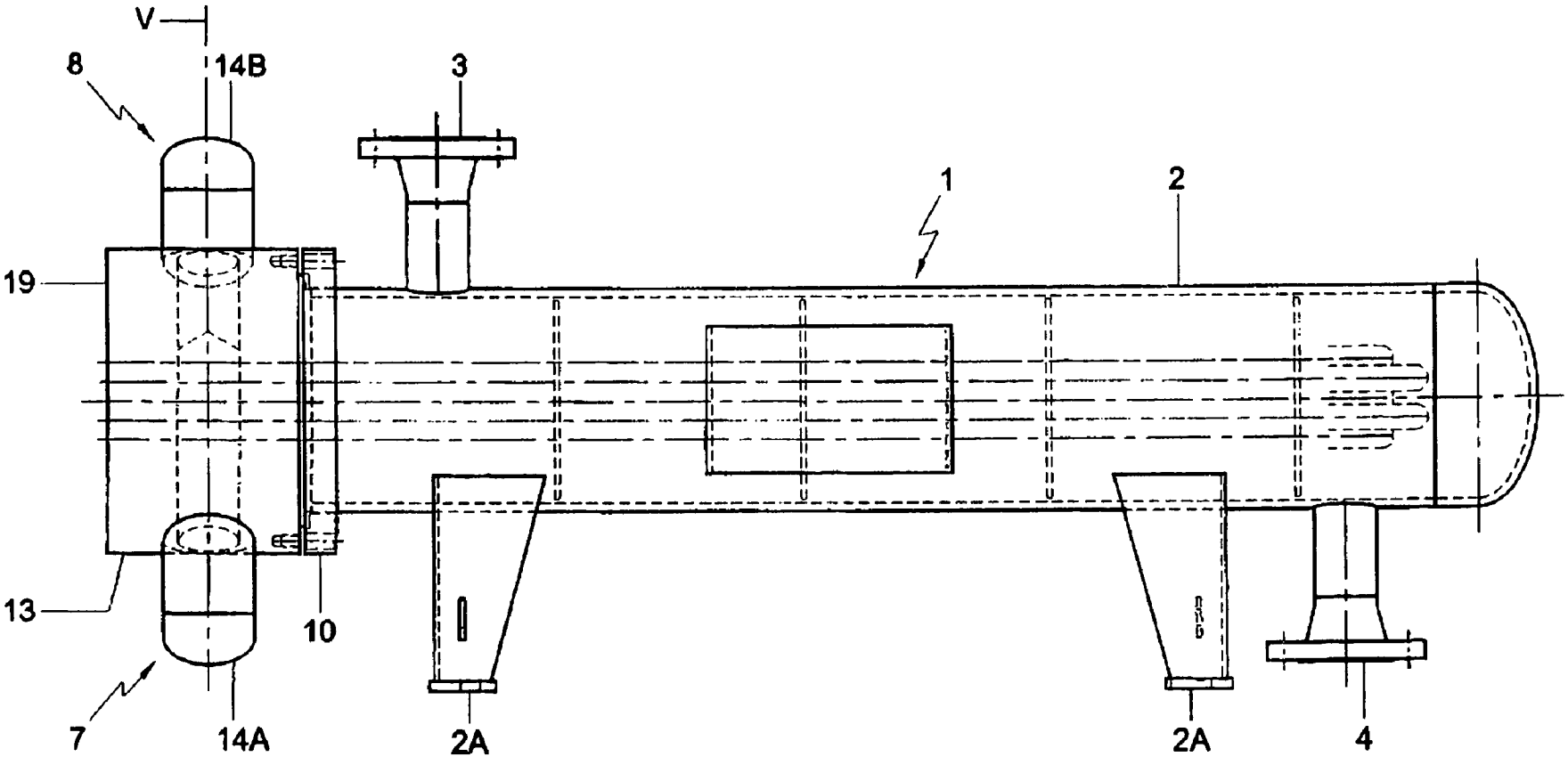
FIG. 1 shows a schematic side view of a heat exchanger according to the invention.
Figure 2:
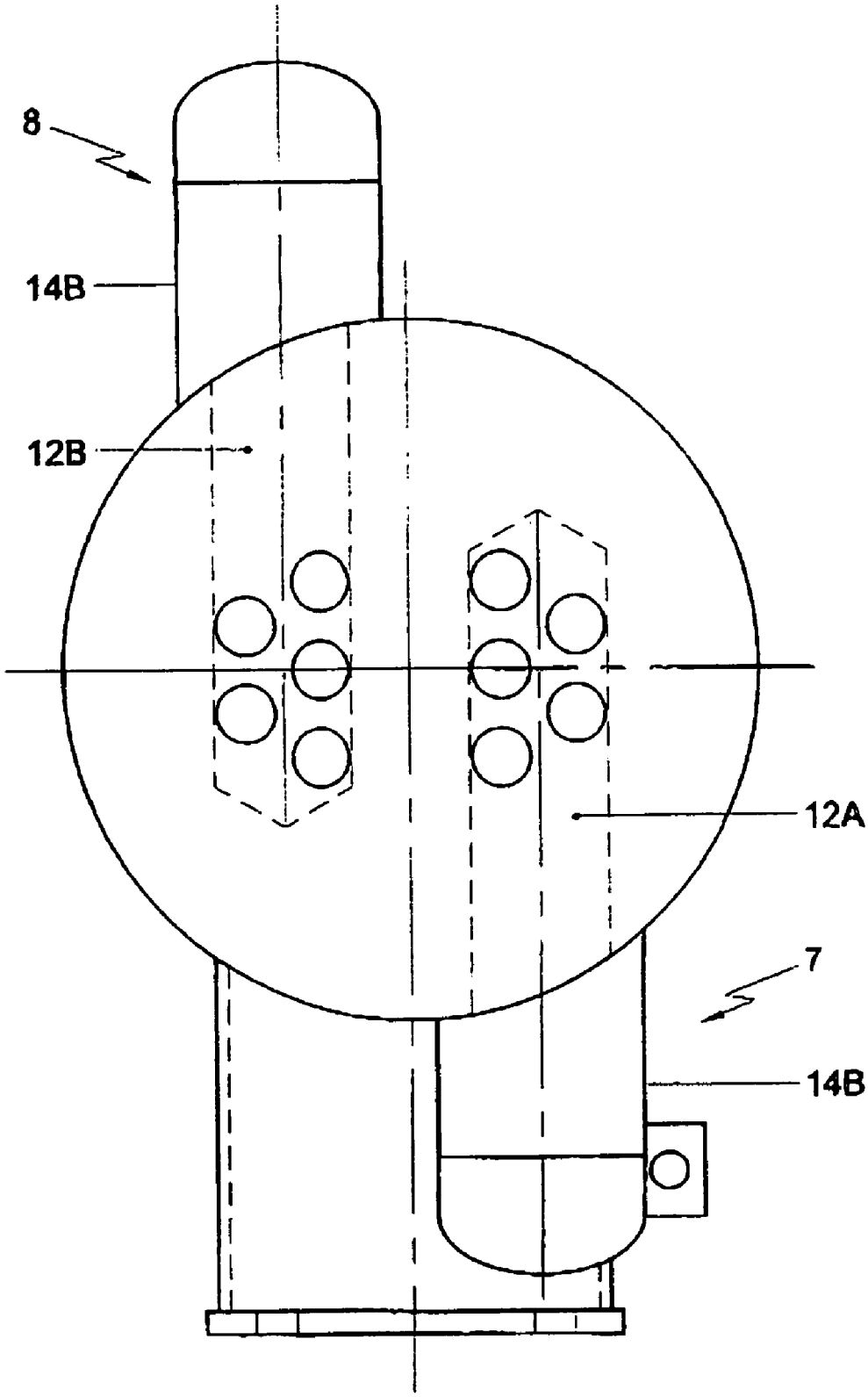
FIG. 2 shows a schematic front view of the heat exchanger of FIG. 1 from the tube plate.
Figure 3:
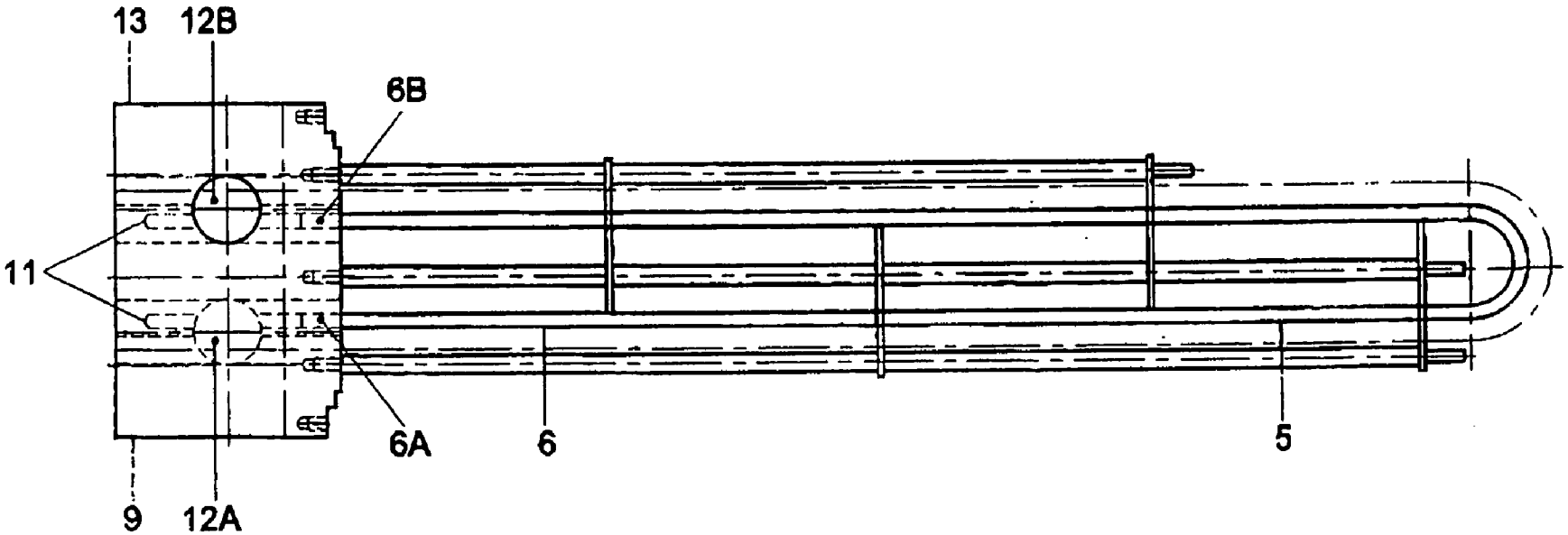
FIG. 3 shows a schematic top plan view of the tube plate and the nest of tubes of the heat exchanger of FIG. 1.

With reference to FIG. 1–FIG. 3, a heat exchanger 1 is shown. The heat exchanger 1 comprises a shell 2 designed as a pressure vessel. The shell 2 of the heat exchanger is positioned on supports 2A. The shell 2 is provided with shell-sided supply means 3 and with shell-sided discharge means 4 with which the shell 2 can be flowed through with a first medium, for instance water under pressure, for instance at least 3 bar. The heat exchanger 1 further comprises a nest 5 of tubes 6 extending within the shell 2. The nest 5 is provided with tube-sided supply means 7 and tube-sided discharge means 8 with which the tubes 6 from the nest 5 can be flowed through with a second medium, for instance natural gas under pressure, for instance 300 bar, such that the first medium and the second medium are in heat exchanging contact.

Depending on the mediums and the use of the heat exchanger, the pressure of the first medium can be chosen to be from, for instance, practically zero (vacuum) to 300 to 400 bar, while the pressure of the second medium can be chosen to be between, for instance, 80 to 700 to 1000 bar.

In the shell 2 of the heat exchanger 1, a tube plate 9 is included. The tube plate 9 is received in the shell 2 of the heat exchanger 1, such that it forms an integral part of the wall. To that end, a tube-shaped end of the wall 2 is screwed onto the tube plate 9 with the aid of a flange 10.

The tube plate 9 is designed as a round disc extending in a plane V. The tube plate 9 is provided with a large number of blind tube bores 11 extending transversely to the plane V. In each tube bore 11, a supply side 6A or a discharge side 6B of a tube 6 is included.

In the tube plate 9, two connecting channels 12A, 12B are provided. The connecting channels 12A, 12B are each designed as a cylindrical bore. The first connecting channel 12A crosses a first group of tube bores 11A, such that the supply sides 6A of the tubes 6 from the nest 5 included in the tube bores 11 are connected with the tube-sided supply means 7. In a corresponding manner, a second connecting channel 12B crosses the tube bores 11B, such that the discharge sides 6B of the tubes 6 from the nest 5 included in the tube bores from that group are connected with the tube-sided discharge means 8.

The tube-sided supply and discharge means are designed as radially outwardly extending tube ends 14A, 14B of respective supply and discharge conduits, provided on the circumferential edge 13 of the tube plate 9.

The tube bores 11 in the tube plate 9 can be designed to be blind, but can also be designed to be continuous and are sealed with plugs as will be explained below in more detail with reference to FIGS. 5 and 6.

Figure 5:
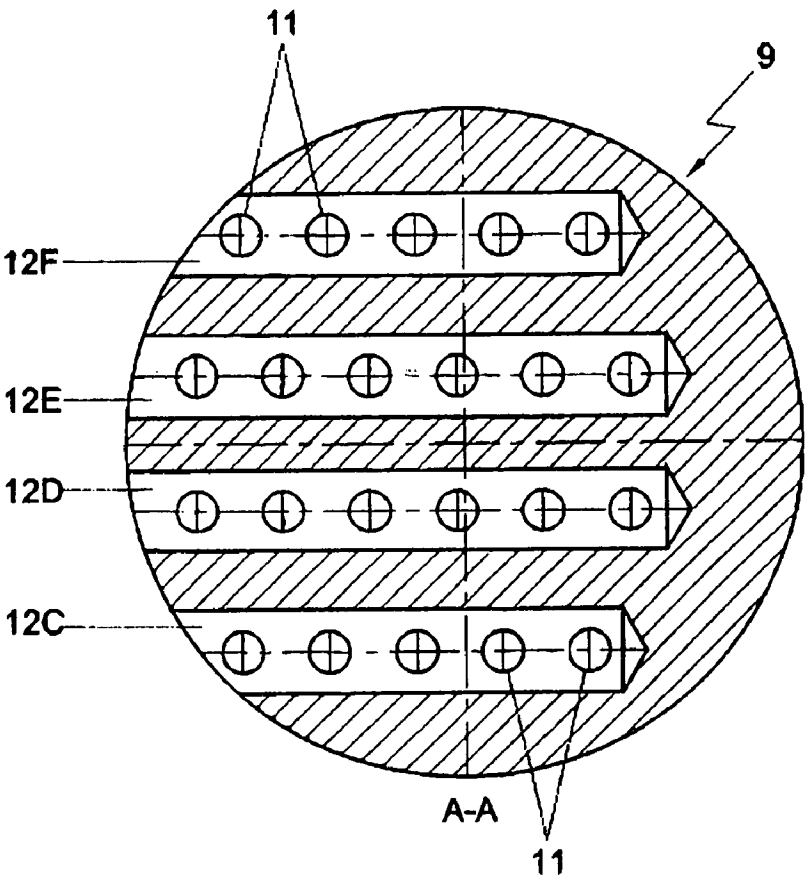
FIG. 5 shows a cross section along the line A—A of the tube plate of FIG. 4.
Figure 4:
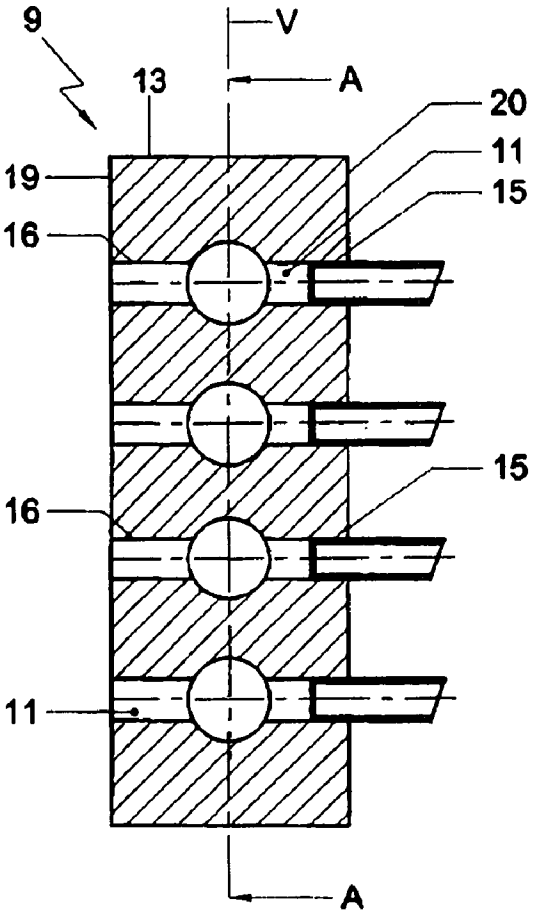
FIG. 4 shows a longitudinal section of an alternative embodiment of the tube plate.
Figure 6A:
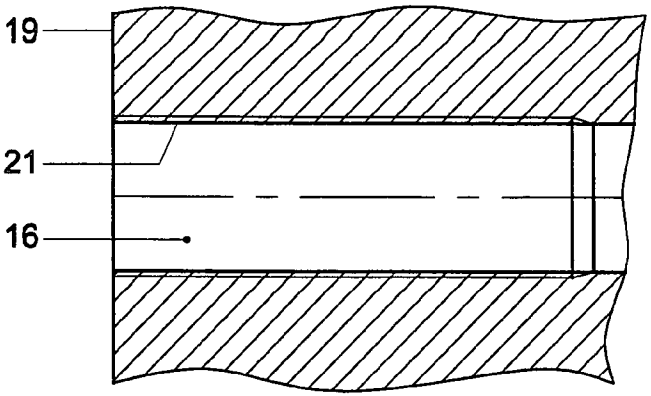
FIG. 6A shows a detail of a free end of a tube bore of the tube plate of FIG. 4.
Figure 6B:
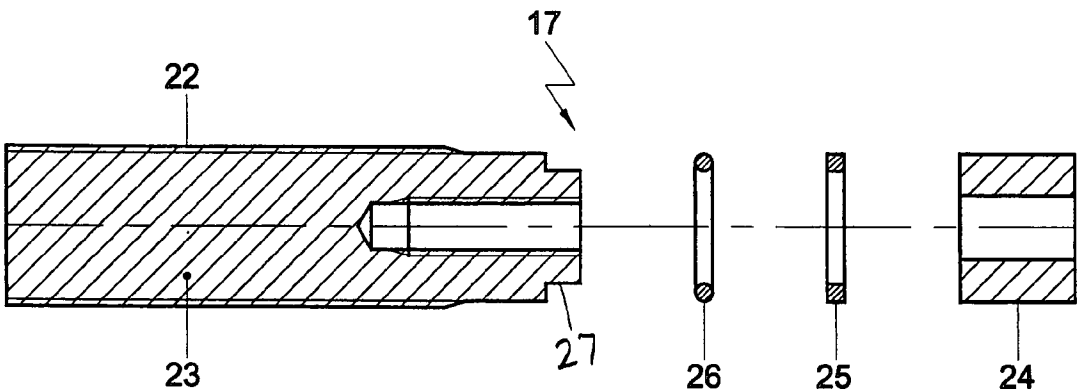
FIG. 6B shows a perspective view of a sealing plug for the tube bore of 6A in a taken-apart condition.

Referring to FIGS. 4–6, it is shown in detail how the tubes 6 with their respective supply sides 6A and discharge sides 6B are included in tube bores 11 of a tube plate 9. The tube bores 11 in the body part of this tube plate are designed to be continuous and extend from a first end 15 located near a back face 20 of the tube plate 9, in which end the tubes 6 are included, to a second free end 16 located near a top face 19 of the tube plate 9, in which end a plug 17 can be received for sealing purposes. Preferably, the tubes 6 are provided in the tube bores 11 by means of a welded joint 18. Such a welded joint 18 can be provided with the aid of a hole weld extending from the top face 19 of the tube plate 9 into the tube bore 11. The tubes 6 can also be provided in the tube bores in different manners, for instance by means of clamping, rolling or screw thread. It is noted that the back face 20 of the tube plate 9 forms part of the wall of the shell 2 of the heat exchanger 1.

With reference to FIG. 5, it is shown that the connecting channels 12 are designed as blind connecting bores 12C–12F, each crossing a row of parallel tube bores 11. As appears from FIGS. 4 and 5, the connecting channels and tube bores 11 are, in each case, surrounded by material of the tube plate 9, so that the pressure exerted by the second fluid can be absorbed on all sides and no resultant pressure force is created on the tube plate 9.

The bores 12C–12F can be connected via a tee with a supply or a discharge conduit, for instance the bores 12C and 12D via an inlet tee and the bores 12E and 12F via an outlet tee.

The second free ends 16 of the tube bores 11 are provided with screw thread 21, as shown in FIG. 6A.

In the screw thread 21, a plug 17 provided with corresponding screw thread 22 can be detachably received. The plug 17 comprises a body part 23 having a recess 27 which can be received in the free end 16 of the tube bore 11. Further, the plug 17 comprises a clamping member 24 which can be screwed onto the body part 23 with the aid of a bolt (not shown), such that a sealing ring 25 and, optionally, a support ring 26 can be retained in the recess 27 and sealingly screwed onto the top face 19 of the tube plate 9. A suitable sealing ring is the "variseal" from the firm of Busak+ Shambam. By detaching the plug 17, a tube 6 from the nest 5 can be made individually accessibly for cleaning purposes.

It will be clear that the invention is not limited to the embodiments represented here. The heat exchanger can comprise, for instance, two tube plates 9 between which a tube nest 5 is provided in a stretched configuration. Then, the shell can be formed by connecting the back faces of the two tube plates with the aid of a tube. The connecting channels from one tube plate can be coupled to the tube-sided supply means, while the connecting channels from the second tube plate are connected with the tube-sided discharge means. It is, however, also possible to connect a first group of tube bores in the first tube plate, via connecting channels, with the tube-sided supply means and to connect a second group of tube bores in the first tube plate, via other channels, with the tube-sided discharge means, while in the second tube plate the connecting channels form a connection between a first group of tube bores and a second group of tube bores.

Further, it is noted that the tube plate can have another shape, for instance rectangular, square or oval.

Furthermore, the tube bores can be sealed in different manners, for instance with hole welds, and the tubes can be connected in different manners, for instance by clamping. Additionally, the plugs can be designed differently, for instance as bolts whose heads function as clamping means for clamping a sealing ring against the top face of the tube plate. Further, the connecting channels can be designed to be continuous and be sealed on one side with a plug or hole weld. Additionally, the channels can be curved.

Such variants will be clear to those skilled in the art and are deemed to be within the scope of the invention as defined in the appended claims.

The invention claimed is:

1. A heat exchanger, comprising:

a) a shell having a shell-sided supply and a shell-sided discharge through which a first medium under pressure can flow;

b) a tube plate fixed to the shell, the tube plate extending generally in a plane and including:

i) a back face ii) a top face, iii) a plurality of supply tube bores and a plurality of discharge tube bores extending substantially transversely to the plane of the tube plate from the back face to the top face, and each tube bore extends through the back face and through the top face, each tube bore having a first diameter segment adjacent to the top face, the first diameter segment having a constant diameter, and a second diameter segment spaced between the back face and the top face, the second diameter segment having a diameter less than the diameter of the first diameter segment, the tube bores are sealed with plugs that extend through the top face, the plugs comprise a body part, a sealing member, and a clamping member, wherein the clamping member is attached to the body part and the sealing ring is arranged between the clamping member and the body part;

iv) at least two connecting channels located in the plane of the tube plate and extending generally transversely to the supply tube bores and the discharge tube bores, a first one of the connecting channels crossing at least a first plurality of the supply tube bores whereby the first plurality of supply tube bores are in flow communication with the first connecting channel, and a second one of the connecting channels crossing at least a first plurality of the discharge tube bores whereby the first plurality of discharge tube bores are in flow communication with the second connecting channel; and v) a tube-sided supply in flow communication with the first connecting channel and a tube-sided discharge in flow communication with the second connecting channel; and c) a nest of tubes extending at least partly within the shell, each tube having a supply side connected to a respective one of the supply tube bores and a discharge side connected to a respective one of the discharge tube bores.

2. A heat exchanger according to claim 1, wherein the plugs are detachably disposed within the supply tube bores and the discharge tube bores, the tube bores at the top face and the plugs are provided with corresponding screw thread.

3. A heat exchanger according to claim 1, wherein a support member is arranged between the clamping member and the body part.

4. A heat exchanger, comprising:

a) a shell having a shell-sided supply and a shell-sided discharge through which a first medium under pressure can flow;

b) a tube plate fixed to the shell, the tube plate extending generally in a plane and including:

i) a back face ii) a top face, iii) a plurality of tube bores extending substantially transversely to the plane of the tube plate from the back face to the top face, each tube bore extending through the back face and through the top face, the tube bores are sealed with plugs that extend through the top face, the plugs comprise a sealing member, a body part having a recess formed in an outer surface thereof and a bore formed therein that extends along a portion of a length of the body part, and a clamping member, wherein the clamping member is coupled to the body part via the bore of the body part, and the sealing member is arranged in the recess between the body part and the clamping member;

iv) at least one connecting channel located in the plane of the tube plate and extending generally transversely to the tube bores, the connecting channel crossing at least a first plurality of the tube bores whereby the first plurality of tube bores are in flow communication with the connecting channel; and c) a nest of tubes extending at least partly within the shell, each tube being connected to a respective tube bore.

5. A heat exchanger according to claim 4, wherein the plugs are detachably disposed within the tube bores, the tube bores at the top face and the plugs are provided with corresponding screw thread.

6. A heat exchanger according to claim 4, wherein a support member is arranged between the clamping member and the body part.

7. A tube plate for use in a heat exchanger, comprising:

a) a back face, b) a top face, c) a plurality of tube bores extending substantially transversely to the back and top faces of the tube plate from the back face to the top face, each tube bore extends through the back face and through the top face, the tube bores are sealed with plugs that extend through the top face, the plugs comprise a body part, a sealing member, and a clamping member, wherein the body part includes an open end and a closed end and the clamping member is attached to the body part in the open end, and the sealing ring is arranged between the clamping member and the body part;

d) at least two connecting channels extending generally parallel to the back face and top face of the tube plate and extending generally transversely to the tube bores, a first one of the connecting channels crossing a first plurality of the tube bores whereby the first plurality of tube bores are in flow communication with the first connecting channel, and a second one of the connecting channels crossing a second plurality of the tube bores whereby the second plurality of tube bores are in flow communication with the second connecting channel; and e) a tube-sided supply in flow communication with the first connecting channel and a tube-sided discharge in flow communication with the second connecting channel.

8. A tube plate according to claim 7, wherein the plugs are detachably disposed within the tube bores, the tube bores at the top face and the plugs are provided with corresponding screw thread.

9. A tube plate according to claim 7, wherein a support member is arranged between the clamping member and the body part.

10. A heat exchanger, comprising:

(a) a shell designed as a pressure vessel having a shell-sided supply and a shell-sided discharge through which a first medium under pressure can flow;

(b) a nest of tubes extending at least partly within the shell having a tube-sided supply and a tube-sided discharge through which a second medium can flow in heat exchanging contact with the first medium under pressure;

(c) a tube plate fixed to the shell, extending generally in a plane, the tube plate comprising a flat body, a back face, a top face, and a plurality of tube bores, (i) the tube bores extending substantially transversely to the plane of the tube plate, from the back face to the top face, (ii) the tube bores are designed to be continuous, (iii) the tube bores located at the top face are sealed with plugs, the plugs comprise a body part and a clamping member, wherein the body part includes a recess formed in an outer surface adjacent to an end of the body part and the clamping member is attached to the body part, and a sealing ring is arranged in the recess between the clamping member and the body part, (iv) each of the tubes is separately connected with the tube-sided supply or the tube-sided discharge in the tube bores, (v) the number of tube bores is equal to the number of tubes, (d) a connecting channel wherein each of the tubes is separately connected with the tube-sided supply or the tube-sided discharge via the connecting channel, wherein the connecting channel is in the plane of the tube plate and crosses the tube bores, wherein the connecting channel includes a circular cross-section having a diameter greater than a diameter of the tube bores.

11. A heat exchanger according to claim 10, wherein the connecting channels comprise straight bores each crossing at least two tube bores.

12. A heat exchanger according to claim 10, wherein the plugs are detachable, the tube bores at the top face and the plugs are provided with corresponding screw thread.

13. A heat exchanger according to claim 10, wherein a support member is arranged in the recess between the clamping member and the body part.

* * * * *